United States Patent [19]

Spence

[11] 4,156,298

[45] May 29, 1979

[54] SHAG RUG FLUFFING AND OBJECT RETRIEVING DEVICE

[76] Inventor: Forrest Spence, 27701 Murrieta Rd., Space 58, Sun City, Calif. 92381

[21] Appl. No.: 885,187

[22] Filed: Mar. 10, 1978

Related U.S. Application Data

[63] Continuation-in-part of Ser. No. 540,135, Jan. 10, 1975, Pat. No. 4,087,879.

[51] Int. Cl.[2] ..... A47L 11/40; A47L 13/40

[52] U.S. Cl. ..... 15/142; 15/388

[58] Field of Search ..... 15/142, 159 A, 171, 15/183, 46, 339, 388; 56/400.04, 400.21; 209/215

[56] References Cited

U.S. PATENT DOCUMENTS

| | | | |
|---|---|---|---|
| 1,196,237 | 8/1916 | Holm | 15/183 |
| 3,232,035 | 2/1966 | Vissers | 15/183 X |
| 3,744,082 | 7/1973 | Marshall | 15/142 X |
| 3,766,588 | 10/1973 | Kopecky | 15/142 |
| 3,852,844 | 12/1974 | Hukuba | 15/142 |

*Primary Examiner*—Christopher K. Moore

*Attorney, Agent, or Firm*—William C. Babcock

[57] ABSTRACT

A wheel-supported shag rug brushing and raking device, which when moved over a shag rug fluffs the long strands of the nap thereof, and concurrently retrieves magnetically attractable objects such as hairpins, bobby pins, and the like. The device is relatively light in weight inasmuch as all or a substantial portion of the components thereof may be injection molded from a suitable polymerized resin. When not in use, the device may be disposed in a position to occupy a minimum of space.

6 Claims, 9 Drawing Figures

FIG. 5
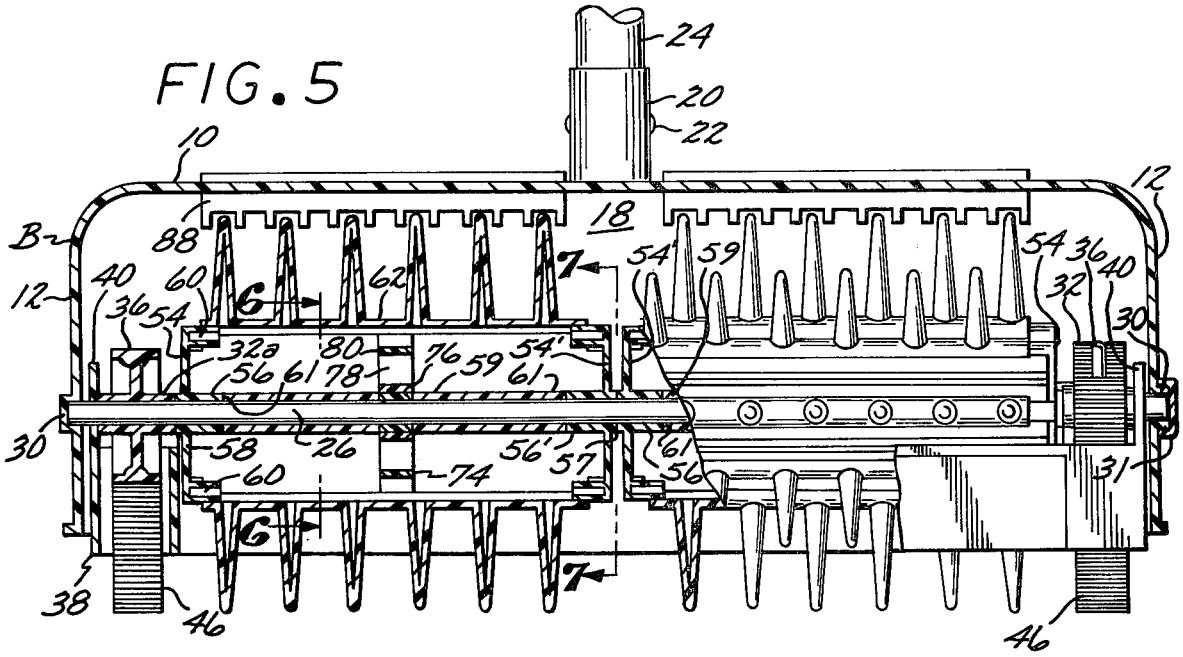
FIG. 6
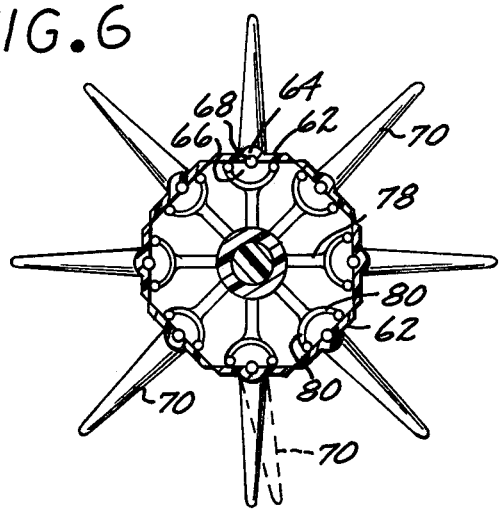
FIG. 7
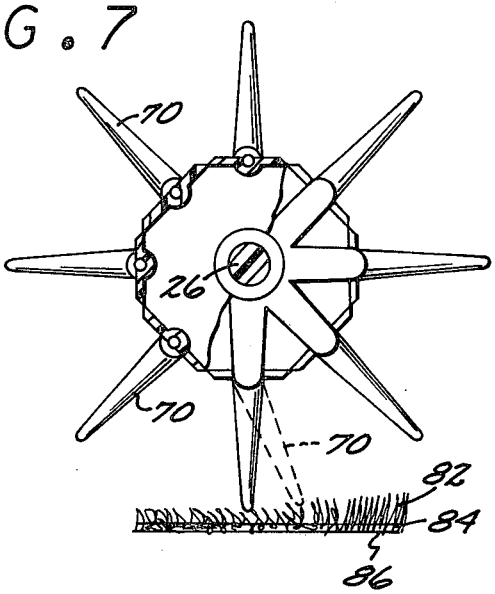
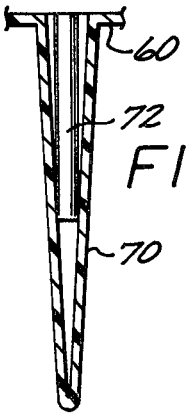
FIG. 8
FIG. 9
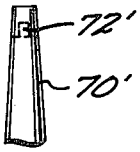

SHAG RUG FLUFFING AND OBJECT RETRIEVING DEVICE

CROSS-REFERENCE TO RELATED APPLICATION

The present application is a continuation-in-part of my application Ser. No. 540,135 filed Jan. 10, 1975, now U.S. Pat. No. 4,087,879, entitled, "Shag Rug Brushing and Object Retrieving Device".

BACKGROUND OF THE INVENTION

1. Field of the Invention

Shag Rug Fluffing and Object Retrieving Device.

2. Description of the Prior Art

In the past few years shag rugs have become increasingly popular as floor coverings. Such rugs, due to the long strands forming the nap thereof, have the disadvantage that the strands become matted and entangled, and also small objects such as bobby pins, hairpins, and the like, drop onto the rug to become concealed within the nap thereof. If such objects are not removed, they will cut the strands of the nap, due to the abrasive action thereof as persons walk over the rug and force the objects into pressure contact with the strands.

Prior to the present invention there has been no lightweight, easily usable device which when moved over a shag rug will concurrently brush and fluff up the strands thereof, as well as remove small magnetically attractable objects therefrom.

The primary object in devising the present invention is to supply a lightweight device that may be easily and conveniently rolled over a shag rug to brush and fluff the strands of the nap thereof, and concurrently remove small magnetically attractable objects from the nap of the rug to prevent such objects from cutting the strands when brought into pressure contact therewith as occurs when persons walk over the rug.

Another object of the invention is to supply a device in which at least the major portion of the components thereof may be formed by injection molding from a polymerized resin, and as a result the device is not only durable but of light weight and easily moved from room to room as required.

A still further object of the invention is to furnish a device that has a relatively simple mechanical structure, requires a minimum of maintenance attention, and when not in use, may be disposed in a position to occupy a minimum of storage space.

SUMMARY OF THE INVENTION

The present invention when moved forwardly and rearwardly over a shag rug is adapted to fluff the strands of the nap thereof to concurrently remove magnetically attractable objects from the rug. The device includes a housing assembly that is preferably of a generally rectangular shape and has a horizontal top piece, a pair of laterally spaced side walls that project downwardly therefrom, forward and rearward end walls that extend downwardly from the top piece, and forward and rearward spaced parallel shaft rotatably supported between the pair of side walls, first and second pairs of spaced circumferentially grooved rollers mounted on the forward and rearward shaft and rearwardly secured thereto, and a handle that is pivotally secured to the top piece and that extends upwardly and rearwardly therefrom at an angle when the invention is being used. The top piece, pair of side walls, and the forward and rearward end walls cooperate to define a downwardly extending confined space.

A carriage assembly is disposed in the confined space and includes a horizontal frame that has a pair of laterally spaced side pieces, a forward side piece, a rearward side piece, first and second pairs of wheels rotatably supported from the pair of side pieces adjacent the first and second pairs of rollers, and longitudinally aligned therewith. The first and second pairs of wheels are capable of resting on the rug, and first and second pairs of elongate flops in the pair of side pieces that are slidably engaged by the forward and rearward shafts, with the wheels of substantially greater diameter than that of the rollers. A pair of taut crossed-over endless belts engage the first and second pairs of grooved rollers. First and second pairs of spaced retainers are rigidly secured to the first and second shaft in longitudinally spaced positions thereon, with each pair of retainers including a number of circumferentially spaced pins that extend towards one another and are parallel to the shaft. A number of elongate strips that have apertured ends are pivotally engaged by the pins, with the strip being disposed in side-by-side relationship and enveloping a major portion of the forward and rearward shaft.

A number of prongs extend outwardly from the strip and are longitudinally spaced thereon, with the prongs being of such length that they engage the strands of the shag rug when in a downward most position. Permanent magnets are supported from the prongs and serve to retrieve magnetically attractable objects from the rug as the prongs engage and pass through the strands of the latter. Springs are provided that at all times tend to maintain the strips and prongs in a predetermined first angular relationship with one another, with the springs allowing one of the strips and the prong extending therefrom to pivot from the first to a second angular relationship when the prong becomes engaged with matted strands that do not readily separate, with the prongs when in the second relationship being angularly disposed relative to the rug and slipping out of engagement with matted strands. The springs return the prongs and the strips supporting the same to the first relationship when the prongs become disengaged from matted strands, with the carriage tending to remain stationary when the housing is moved forwardly and rearwardly relative to the rug due to frictional contact between the prongs and strands. The first and second shafts and the prongs supported therefrom rotate towards one another at a velocity different from that of the housing as the latter is moved forwardly and rearwardly over the rug due to the forward and rearward pairs of wheels that are rotating, alternately and frictionally engaging the first and second pairs of rollers due to forward and rearward movement of the forward and rearward shaft in the first and second pairs of slots. The device also includes magnetic means supported from the housing for removing magnetically attractable objects from the prongs as the latter rotate.

BRIEF DESCRIPTION OF THE DRAWINGS

FIG. 5 is a combined transverse cross-sectional and elevational view of the device;

FIG. 6 is a vertical cross-sectional view of one of the shafts and the prong supporting assembly mounted thereon;

FIG. 7 is an end elevational view of one of the retainers and prongs supported thereon;

FIG. 8 is an enlarged longitudinal cross sectional view of one of the prongs; and FIG. 9 is a fragmentary side elevational view of a second form of prong.

DESCRIPTION OF THE PREFERRED EMBODIMENT

Figure 1:
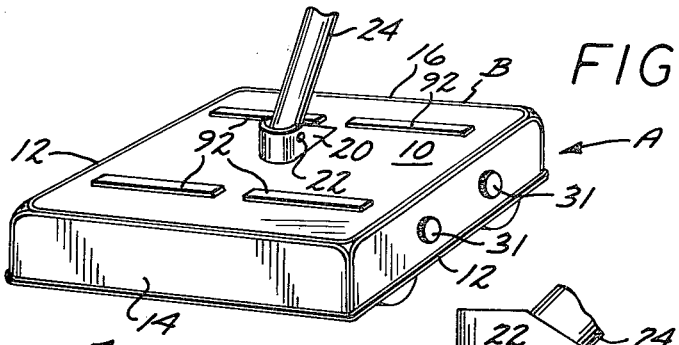
FIG. 1 is a perspective view of the shag rug fluffing and magnetic attractable object retrieving device.

The invention A as may best be seen in FIG. 1 includes a housing B. The housing B has a top piece 10 that is substantially horizontal and has a pair of laterally spaced side walls 12 projecting downwardly therefrom, together with a forward end wall 14 and a rearward end wall 16. The top piece 10, pair of side walls 12, and the forward and rearward end walls 14 and 16 cooperate to define a downwardly extending confined space.

The top piece 10 has a centrally disposed U-shaped bracket 20 extending upwardly therefrom, which bracket supports a transverse pin 22 that pivotally engages a lower end of an elongate handle 24, which handle when the invention A is in use is disposed to extend upwardly and rearwardly from the top piece 10 at a substantially forty-five degree angle.

Figure 2:
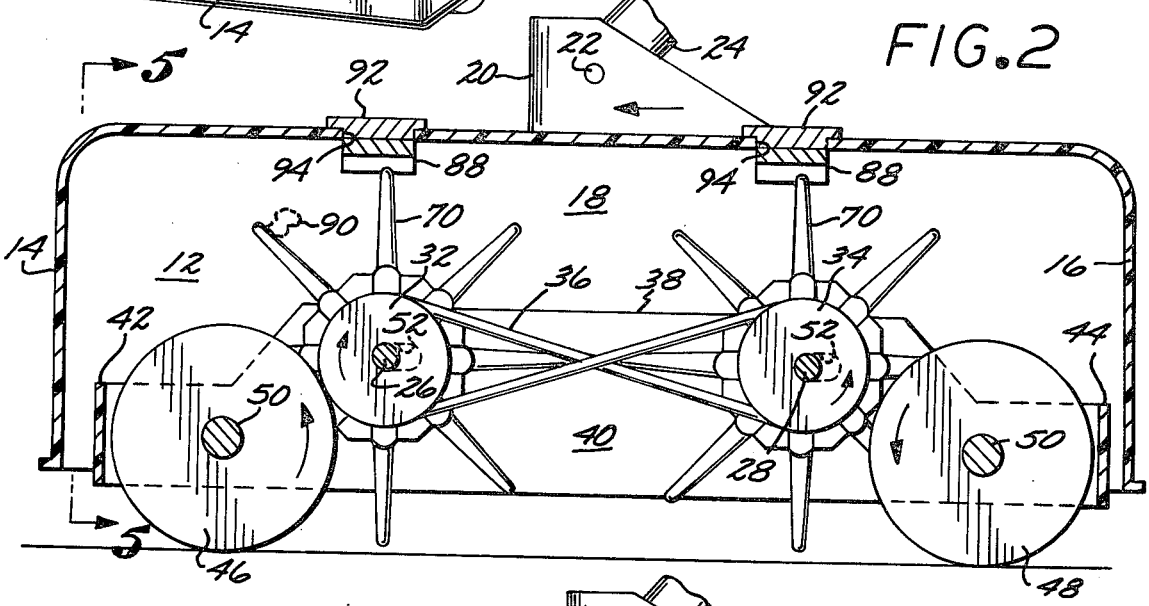
FIG. 2 is a first longitudinal cross-sectional view of the device with the rotatable prong being driven by rotation of a first pair of wheels as the device is moved forwardly.
Figure 3:
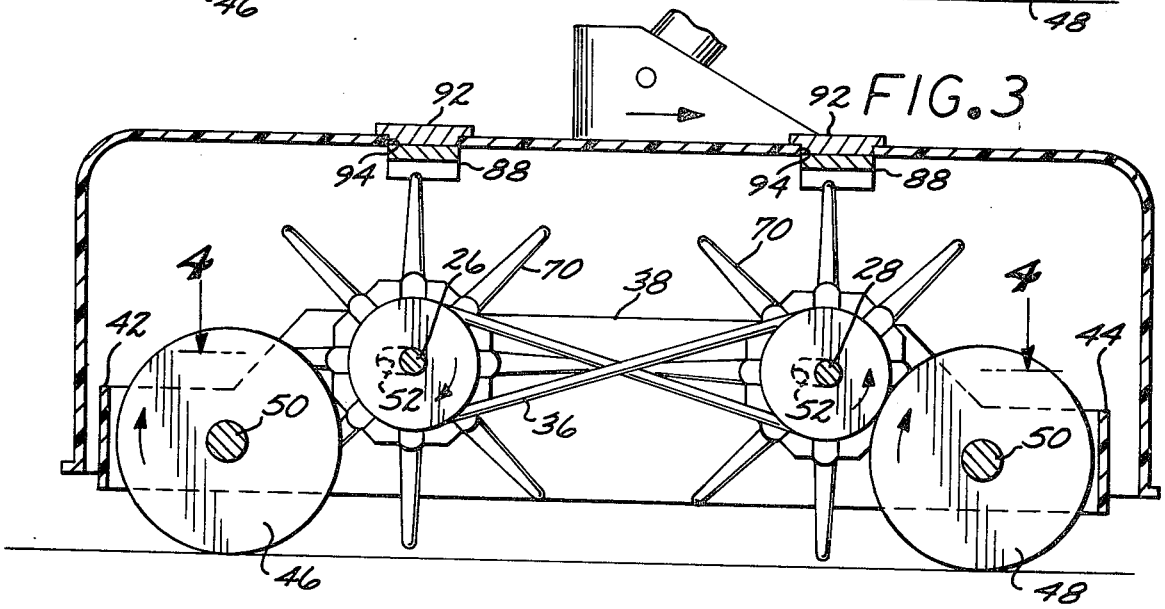
FIG. 3 is the same view as shown in FIG. 2 but with the prongs being rotated by a rearwardly disposed pair of wheels as the device is moved rearwardly.
Figure 4:
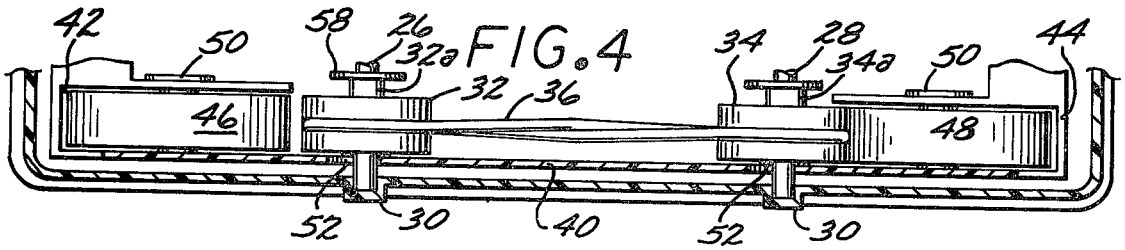
FIG. 4 is a fragmentary combined horizontal cross-sectional and top plan view of the device taken on the line 4—4 of FIG. 3.

A forward shaft 26 and rearward shaft 28 extend transversely between the pair of side walls 12 and have the ends of the shaft rotatably supported in tubular recessed portions preferably formed as a part of the side walls, which portions are identified on the drawing by the numeral 30. One set of the recessed portions 30 may be externally threaded and removably engaged by internally threaded caps 31 that permit shafts 26 and 28 to be removed from and inserted in housing B. A first pair of laterally spaced grooved rollers 32 having tubular hubs 32*a* are rotatably supported on the forward shaft 26. Likewise, a second pair of grooves and hubbed rollers 34 are rotatably supported on the rearward shaft 28 and longitudinally aligned with first rollers 32. The first and second pairs of grooved rollers 32 and 34 are drivingly engaged by two pairs of taut crossed-over endless belts 36, one of which belts is shown in FIGS. 2, 3 and 4.

A clutch frame 38 is situated within the confined space 18, with the frame being defined by a pair of parallel laterally spaced side pieces 40, a forward end piece 42, and a rearward end piece 44. The clutch frame 38 has a number of stub shafts 50 projecting inwardly therefrom that serve to rotatably support a pair of forwardly disposed driving wheels 46 and a pair of rearwardly positioned driving wheels 48, with the driving wheels being of substantially greater diameter than the driven rollers 32 and 34 as shown in FIG. 2. The pair of side pieces 40 of the frame 38 have two sets of elongate slots 52 formed therein in which the forward and rearward shafts 26 and 28 are slidably disposed, and as a result the frame 38 may move forwardly and rearwardly relative to the housing B, with this movement being limited by the length of the slot 52.

Each of the rollers 32 and 34 on the inwardly disposed ends of the hubs thereof develops into an end cap retainer 54 or has such a retainer rigidly secured thereto. Each retainer 54 includes a sleeve 56 that is rotatably mounted on the shaft 26 or 28 associated with the rollers 32 and 34, with the sleeve having a number of circumferentially spaced arms 58 extending radially and outwardly therefrom, and the arms on their outer ends developing into a number of pins 60 that are parallel to the shaft 26 and 28 as shown in FIG. 5.

A number of elongate strips 62 are provided with each strip including a longitudinally extending outwardly projecting semi-circular center portion 64 and two inwardly extending end portions 66, which center portion and end portions cooperate to define two longitudinally aligned openings 68 therebetween. Pins 60 pivotally engage the openings 68 most adjacent thereto serve to pivotally support the strip 62 in an angular first relationship with one another as shown in FIG. 6, and with the longitudinal edges of the strips being disposed adjacent to one another. Each of the strips 60 has a number of longitudinally spaced, tapered prongs 70 projecting outwardly therefrom.

One of the prongs 70 is illustrated in FIG. 8 and is shown as being hollow and serving as an envelope for a permanent magnet 72. The prong 70 as may be seen in FIG. 8 is preferably of tapered structure.

Each of the forward and rearward shafts 26 and 28 preferably has two end cap retainers 54′ disposed at substantially the center thereof with the second end cap retainers being oppositely disposed. The second end cap retainers 54′ are rotatably supported on the forward or rearward shaft 26 and 28 on which they are mounted by sleeves 56′. The second end cap retainers 54′ are identical in structure to the first end cap retainers 54 other than they are not connected to the roller 32 or 34. The sleeves 54′ on forward and rearward shafts 26 and 28 have the sleeves 56′ thereof in abutting contact. The ends of sleeves 56′ in abutting contact have engaging teeth 57 formed thereon, and the teeth causing the second end cap retainers 54′ to rotate concurrently. The forward and rearward shafts 26 and 28 preferably have two spring units 74 mounted on the tubular members 59 mounted thereon, with each spring unit being centrally disposed between one of the sets of first and second end cap retainers 54 and 54′ as shown in FIG. 5.

Each spring unit 74 includes a hub 76 mounted on a tubular member 59 with the hub having a number of circumferentially spaced arms 78 projecting outwardly therefrom. Each of the arms 78 develops on the other end into two resilient angularly disposed legs 80 that pressure contact the interior surface of one of the strips 62. The legs 80 tend at all times to maintain the strips 62 and prongs 70 in the first angular relationship shown in FIGS. 6 and 7. The length of the prongs 70 is so related to the diameter of the wheels 46 and 48 that when the invention A is moved over a shag rug 80, the downmost prongs 70 extend into the strands 82 of the nap 84 of the rug and frictionally engage the same.

Due to this frictional engagement the clutch frame 38 and the elements associated therewith tend to remain in a stationary position relative to the shag rug 86 when the housing is moved forwardly. When the housing B moves forwardly as can be seen in FIG. 2, the forward pair of rollers 32 to rotate the same and the components associated therewith, and cause the prongs 70 associated with this shaft to rotate in a clockwise direction. The crossed-over belt 36 transmits motion to the rearwardly disposed rollers 34 to cause them and the prongs 70 supported on the rearward shaft 28 to rotate in a counterclockwise direction. When one of the prongs 70 encounters strands 82 that are matted or slightly knotted together and do not readily separate, the prong may pivot to the position shown in phantom line in FIGS. 6 and 7. When the invention A is moved rearwardly over the shag rug 86, the operation previously described is reversed, with the rearward pair of wheels 48 now frictionally contacting the second pair of rollers 34 to rotate the latter in a counterclockwise direction, and the second pair of rollers 34 transmitting motion through the belts 36 to the forward pair of rollers 32. Irrespective of whether the invention A is being moved forwardly or rearwardly over the rug, the two sets of prongs 70 shown in FIGS. 2 and 3 rotate towards one another.

A second form 70' of prong is shown in FIG. 9 that differs from the first form 70 in that the permanent magnet 72' is located in the tip of the prong. Two sets of permanent magnets 88 preferably in the form of a comb, are supported from the top piece 10, and these magnets being of greater power than the magnets 72 or 72'. As a result, when a magnetically attractable object 90 shown in phantom line in FIG. 2 is retrieved from the rug by one of the magnets 72 or 72', the object will be withdrawn from the prong as it passes the magnet 88. The magnets 88 may be permanently secured to the interior surface of the top piece 10, but preferably are supported from flanged bodies 92 that permit the magnets to be extended downwardly through openings 94 formed in the top piece 10. The bodies 92 and the magnets 88 supported therefrom may be periodically removed from the openings 94, and objects 90 that have been attracted and supported by the magnets 88 may be easily and conveniently separated therefrom. The outer ends of the hubs **32*a* and 34*a* are in rotatable pressure contact with the interior surfaces of side pieces 40, and the teeth 57 and 61 are held in engagement to cause the two rotatable prong assemblies shown in FIGS. 2 and 3 to rotate as integral units on the shafts 26 and 28**. From the description of the invention it will be seen that all of the components thereof may be molded from a suitable polymerized resin such as polypropylene or the like.

The use and operation of the invention has been previously described in detail and need not be repeated.

What is claimed is:

1. A device for fluffing the strands of a shag rug and concurrently removing magnetically attractable objects therefrom, said device including:

a. a housing assembly that includes a generally rectangular horizontal top piece, a pair of laterally spaced side walls projecting downwardly therefrom, forward and rearward end walls that extend downwardly from said top piece, forward and rearward spaced parallel shafts rotatably supported by said pair of side walls and extending therebetween, first and second pairs of spaced circumferentially grooved rollers rotatably supported on said forward and rearward shafts, an elongate handle that has first and second ends, and first means for pivotally connecting said second end of said handle to said top piece at a position intermediate said forward and rearward end walls, said top piece, pair of side walls, and forward and rearward end walls cooperating to define a downwardly extending confined space;

b. a carriage assembly disposed in said confined space that includes a horizontal clutch frame that has a pair of laterally spaced side pieces, a forward end piece, a rearward end piece, first and second pairs of wheels rotatably supported from said pair of side pieces adjacent said first and second pairs of rollers and longitudinally aligned therewith, said first and second pairs of wheels capable of resting on said rug, and first and second pairs of elongate slots in said pair of side pieces that are slidably engaged by said forward and rearward shafts, said wheels of substantially greater diameter than that of said rollers;

c. a pair of taut crossed-over endless belts that engage said first and second pairs of grooved rollers;

d. first and second pairs of first spaced end retainers rotatably mounted on said forward and rearward shafts in longitudinally spaced positions thereon, each of said pair of end retainers including a plurality of circumferentially spaced pins that extend towards one another and are parallel to said shaft, said first and second pairs of end retainers removably connected to said first and second pairs of grooved rollers;

e. a plurality of elongate strips having apertured ends that pivotally engage said pins, said strips being disposed in side-by-side relationship and enveloping a major portion of said forward and rearward shafts;

f. a plurality of prongs that extend outwardly from said strips and are longitudinally spaced thereon, said prongs being of such length that they engage said strands when in a downwardmost position;

g. permanent magnet means supported from said prongs for retrieving magnetically attractable objects from said rug as said prongs engage the latter; and h. spring means that at all times tend to maintain said strips and prongs in a predetermined first angular relationship with one another, said spring means allowing one of said strips and the prong extending therefrom to pivot from said first to a second angular relationship when said prong becomes engaged with matted strands that do not readily separate, said prongs when in said second relationship being angularly disposed relative to said rug and slipping out of engagement with said matted strands, said spring means returning said prongs and the strips supporting same to said first relationship when said prongs become disengaged from said matted strands, with said carriage tending to remain stationary when said housing is moved forwardly and rearwardly relative to said rug due to frictional contact between said prongs and strands, and said first and second pairs of end retainers, strips, and said prongs supported therefrom being rotated circumferentially towards one another at a velocity different from that of the horizontal velocity said housing as the latter is moved forwardly and rearwardly, due to said forward and rearward pairs of wheels that are rotating, alternately and frictionally engaging said first and second pairs of rollers due to forward and rearward movement of said forward and rearward shafts in said first and second pairs of slots.

2. A device as defined in claim 1 which in addition includes:

i. means on said housing for removing magnetically attractable objects from said prongs as the latter rotate.

3. A device as defined in claim 1 in which said prongs are hollow and said permanent magnet means are situated within the interior thereof.

4. A device as defined in claim 1 in which said permanent magnet means are permanent magnets mounted on said prongs adjacent the outer extremities thereof.

5. A device as defined in claim 1 in which each of said end retainers includes:

i. a tubular hub rotatably mounted on said shaft; and j. a plurality of circumferentially spaced, radially disposed arms that extend outwardly from said sleeve, and each of said arms supporting one of said pins.

6. A device as defined in claim 1 in which said spring means includes:

i. a tubular hub;

j. a plurality of circumferentially spaced, radially extending resilient arms supported by said tubular hub; and k. a plurality of pairs of angularly disposed resilient legs supported from the outer extremities of said arms that contact the interior surfaces of said strips and tend at all times to maintain said strips in said first relationship.

* * * * *